US008111117B2

(12) United States Patent
Minowa et al.

(10) Patent No.: US 8,111,117 B2
(45) Date of Patent: Feb. 7, 2012

(54) ELECTROMAGNETIC RELAY

(75) Inventors: Ryota Minowa, Kyoto (JP); Hironori Sanada, Kyoto (JP); Norio Fukui, Kyoto (JP)

(73) Assignee: OMRON Corporation, Kyoto (JP)

( * ) Notice: Subject to any disclaimer, the term of this patent is extended or adjusted under 35 U.S.C. 154(b) by 245 days.

(21) Appl. No.: 12/294,092

(22) PCT Filed: Mar. 29, 2007

(86) PCT No.: PCT/JP2007/056859

§ 371 (c)(1),
(2), (4) Date: Sep. 23, 2008

(87) PCT Pub. No.: WO2007/114248

PCT Pub. Date: Oct. 11, 2007

(65) Prior Publication Data

US 2009/0115557 A1 May 7, 2009

(30) Foreign Application Priority Data

Mar. 31, 2006 (JP) ..... 2006-098264

(51) Int. Cl.
*H01H 51/22* (2006.01)

(52) U.S. Cl. ..... 335/78; 335/129

(58) Field of Classification Search ..... 335/78–86, 335/128–132

See application file for complete search history.

(56) References Cited

U.S. PATENT DOCUMENTS 5,239,281 A * 8/1993 Tomono et al. ..... 335/78
5,270,674 A * 12/1993 Nakanishi et al. ..... 335/78
5,392,015 A * 2/1995 Matsuoka et al. ..... 335/78
6,486,760 B2 * 11/2002 Miyazaki et al. ..... 335/78
6,496,090 B1 * 12/2002 Nishida et al. ..... 335/202
6,606,018 B2 * 8/2003 Takano et al. ..... 335/78
6,940,375 B2 * 9/2005 Sanada et al. ..... 335/86

FOREIGN PATENT DOCUMENTS

JP 3-69848 7/1991
JP 3-069848 7/1991
JP 4-272628 9/1992

(Continued)

OTHER PUBLICATIONS

Patent Abstracts of Japan, Publication No. 2000-348590, dated Dec. 15, 2000, 1 page.

(Continued)

*Primary Examiner* — Bernard Rojas
(74) *Attorney, Agent, or Firm* — Osha • Liang LLP

(57) ABSTRACT

An electromagnetic relay includes an electromagnetic block formed by winding a coil around an iron core and a frame shaped card. One end portion of the frame-shaped card is engaged with a movable iron piece that is rotated by being attracted to and separated from a magnetic pole portion of the iron core based on excitation and non-excitation of the electromagnetic block. The electromagnetic relay also includes a contact mechanism portion configured to be driven by the other end portion of the frame-shaped card that makes a reciprocating movement so as to open/close contacts and a pair of protrusions protrusively provided on the same shaft center inside of the one end portion of the frame-shaped card. Both side edge portions of the movable iron piece are held by the one end portion of the card and the protrusions. An adjustment opening is provided between the pair of protrusions.

7 Claims, 8 Drawing Sheets

FOREIGN PATENT DOCUMENTS

| | | |
|---|---|---|
| JP | 08-235996 | 9/1996 |
| JP | 2000-348590 | 12/2000 |

OTHER PUBLICATIONS

Patent Abstracts of Japan, Publication No. 08-235996, dated Sep. 13, 2996, 1 page.

International Search Report issued in International Application No. PCT/JP2007/056859, mailed on May 1, 2007, 2 pages.

Patent Abstracts of Japan, Publication No. 04-272628 dated Sep. 29, 1992, 1 page.

Office Action in Japanese Patent Application No. 2006-098264, Dated Jan. 4, 2011 (5 Pages with English Translation).

* cited by examiner (A)

(B)

(A)

(B)

ELECTROMAGNETIC RELAY

TECHNICAL FIELD

The present invention relates to an electromagnetic relay, in particular to an attachment structure of a card for driving a contact mechanism portion.

BACKGROUND ART

Conventionally, as an electromagnetic relay, for example, there is one wherein, based on excitation and non-excitation of an electromagnetic assembly X, a movable contact spring 9 is rotated by a card 12 that makes a reciprocating movement by rotation of an armature 7 to open/close contacts (refer to Patent Document 1).

In the above electromagnetic relay, engagement portions 12*a*, 12*b* protruding sideways from one end side of the card 12 are engaged with notch portions 7*b*, 7*c* of the armature 7 so as to be supported.

Patent Document 1: JP4-272628A

DISCLOSURE OF INVENTION

Problem to be Solved by the Invention

However, in the above electromagnetic relay, as shown in FIGS. 1 and 2 of the Patent Document 1, one side of a frame portion of the card 12 located at a basal portion of the engagement portions 12*a*, 12*b* is disposed directly overhead between a magnetic pole portion of an iron core 4 and the movable iron piece 7. Therefore, in the above electromagnetic relay, adjustment cannot be made by inserting a thickness gauge when adjusting operation characteristics, so that adjustment work requires a lot of time and effort, and there is a problem that variations in operation characteristics tend to increase.

In view of the above problem, an object of the present invention is to provide an electromagnetic relay whose operation characteristics are easily adjusted and in which variations in the operation characteristics are small.

Means of Solving the Problem

In order to solve the above problem, in an electromagnetic relay of the present invention, one end portion of a frame-shaped card is engaged with a movable iron piece that is rotated by being attracted to and separated from a magnetic pole portion of an iron core based on excitation and non-excitation of an electromagnetic block formed by winding a coil around the iron core, and a contact mechanism portion is driven by the other end portion of the frame-shaped card that makes a reciprocating movement so as to open/close contacts, a pair of protrusions are protrusively provided on the same shaft center inside of the one end portion of the frame-shaped card, both side edge portions of the movable iron piece are held by the one end portion of the card and the protrusions, and an adjustment opening is provided between the protrusions.

Effect of the Invention

According to the present invention, since the adjustment opening is provided between the protrusions provided on the same shaft center inside of the card, by inserting a thickness gauge into the adjustment opening, adjustment work of the operation characteristics is facilitated and an electromagnetic relay having the good operation characteristics is obtained.

In another electromagnetic relay of the present invention, one end portion of a frame-shaped card is engaged with a movable iron piece that is rotated by being attracted to and separated from a magnetic pole portion of an iron core based on excitation and non-excitation of an electromagnetic block formed by winding a coil around the iron core, and a contact mechanism portion is driven by the other end portion of the frame-shaped card that makes a reciprocating movement so as to open/close contacts, a pair of protrusions are protrusively provided on the same shaft center inside of the one end portion of the frame-shaped card, and the center of the one end portion of the card is provided with a slit, whereby both side edge portions of the movable iron piece are held by the one end portion of the card and the protrusions, and an adjustment opening may be provided between the protrusions.

According to the present invention, in addition to the above effect, by the slit provided in the center of the one end portion of the card, the one end side of the card is easily elastically deformed, so that assembling of the movable iron piece is facilitated.

In an embodiment of the present invention, an upper end edge portion of the movable iron piece may be provided with an engagement pawl engaged with the one end portion of the frame-shaped card.

According to the present embodiment, the movable iron piece is engaged with the frame-shaped card so as to prevent the frame-shaped card from coming off, so that reliability is improved.

In another embodiment of the present invention, intermediate portions on both opposite sides of the frame-shaped card may be bridged over by a connection portion.

According to the present embodiment rigidity of the frame-shaped card is improved so that it is hardly deformed. Therefore, there is an effect that operation characteristics are improved.

DESCRIPTION OF REFERENCE NUMERALS

Figure 1:
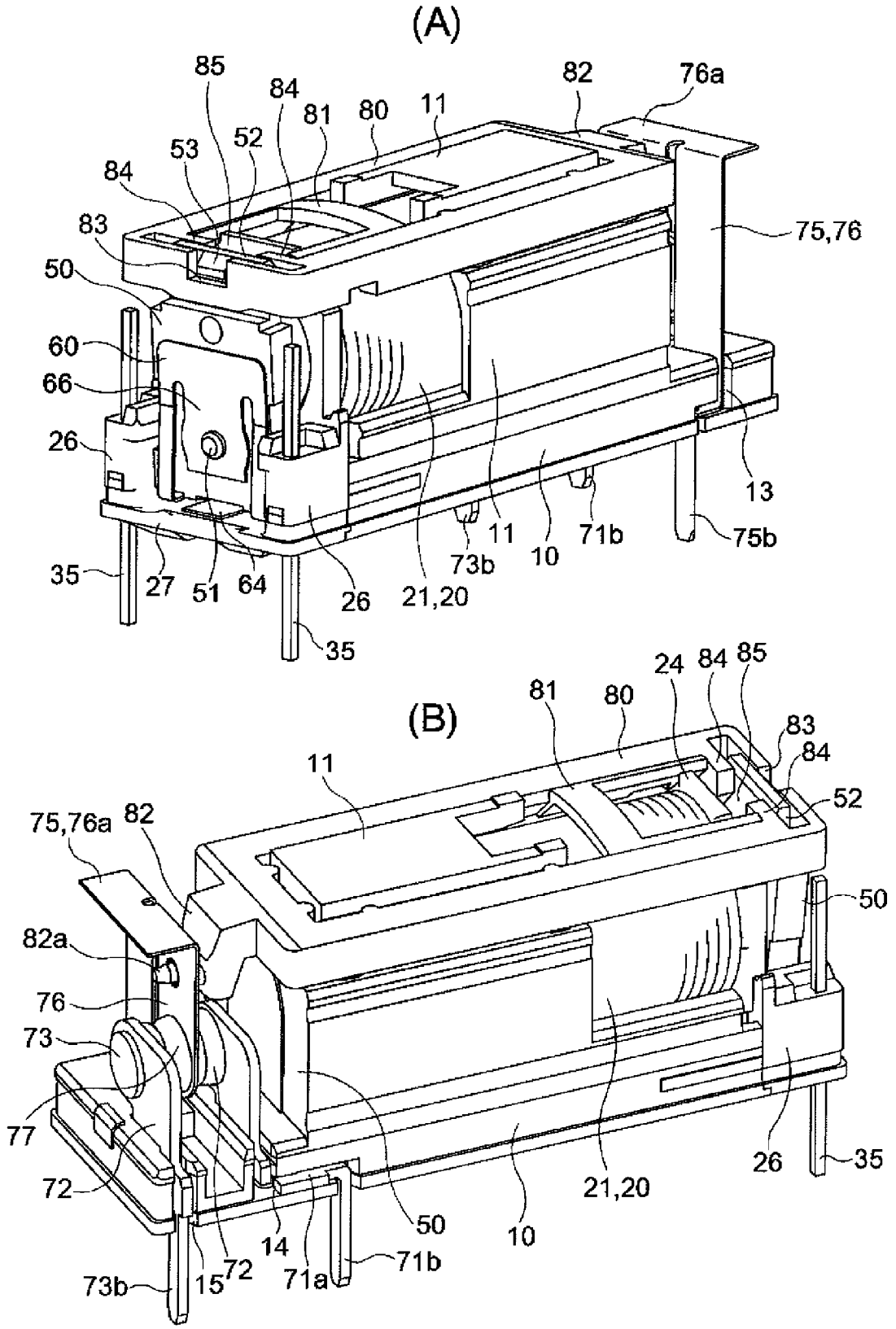
FIG. 1A and FIG. 1B are perspective views respectively showing a first embodiment of the electromagnetic relay of the present invention from different angles.

10: base
11: cylindrical-shaped cover
12: engagement pawl
20: electromagnetic block
22: spool
23: body portion
24, 25: flange portion

26: pedestal portion
26*a*: insertion opening
27: receiving portion
30: iron core
31: magnetic pole portion
32: the other end portion
35: coil terminal
40: yoke
41: vertical portion
42: caulking hole
43: thin neck portion
44: horizontal portion
45: shallow groove
50: movable iron piece
52: upper side portion
53: engagement pawl
60: hinge spring
61: horizontal portion
62: positioning rib
62*a*: elastic pawl portion
63: press-fitting elastic tongue piece
65: vertical portion
66: supporting elastic tongue piece
70: contact mechanism portion
71: normally-closed fixed contact terminal
72: normally-closed fixed contact
73: normally open fixed contact terminal
74: normally open fixed contact
71*a*, 73*a*, 75*a*: press-fitting portion
75: movable contact terminal
76: movable contact piece
77: movable contact
80: card
81: connection portion
82: pressing arm portion
82*a*: engagement projection
83: engagement recess
83*a*: slit
84: protrusion
85: adjustment opening
90: case
91: thickness gauge
92: gauge portion

BEST MODE FOR CARRYING OUT THE INVENTION

Embodiments of the present invention will be described in accordance with the accompanying drawings of FIGS. 1 to 8.

A first embodiment is generally constructed of a base 10, an electromagnetic block 20, a movable iron piece 50, a contact mechanism portion 70, a card 80 and a case 90 as shown in FIGS. 1 to 6.

The base 10 is obtained by integrally molding at its upper surface central portion a cylindrical-shaped cover 11 provided with a partition wall at its back side. The base 10 has a structure that allows the electromagnetic block 20 described below to slide from one side so that it can be assembled thereto. Further, both upper surface side edge portions on the opening side of the cylindrical-shaped cover 11 of the base 10 are respectively provided with engagement pawls 12, 12 protruding therefrom for being engaged with both upper surface side edge portions of a yoke 40 described below.

In the electromagnetic block 20, a coil 21 is wound around a body portion 23 of a spool 22 having flange portions 24, 25 at its both ends. Then, an iron core 30 having a generally T-shape in cross section is inserted into a through hole 23*a* in the body portion 23, one end portion thereof that protrudes serves as a magnetic pole portion 31, and the other end portion 32 that protrudes is fixed by caulking to a vertical portion 41 of the yoke 40 described below.

Both side edge portions of the one side flange portion 24 are respectively provided with pedestal portions 26, 26 protruding therefrom, and lower side edge portions of the pedestal portions 26, 26 are connected with a receiving portion 27. An insertion opening 26*a* through which a horizontal portion 44 of the yoke 40 can be inserted is provided between the receiving portion 27 and the flange portion 24. Further, coil terminals 35, 35 are respectively press-fitted into the pedestal portions 26, 26, and lead-out wires of the coil 21 are tied and soldered to upper end portions of the coil terminals 35 that protrude therefrom.

The yoke 40 is made of a magnetic material generally having an L-shape. A vertical portion 41 thereof is formed with a caulking hole, and a shallow groove 45 having an arc shape in cross section along an outer peripheral surface of the coil 21 is formed in the upper surface center of the horizontal portion 44 along a lengthwise direction. Further, a basal portion of the vertical portion 41 is formed with a thin neck portion 43 having a narrow width. Therefore, there is an advantage that bending work is facilitated.

Figure 3:
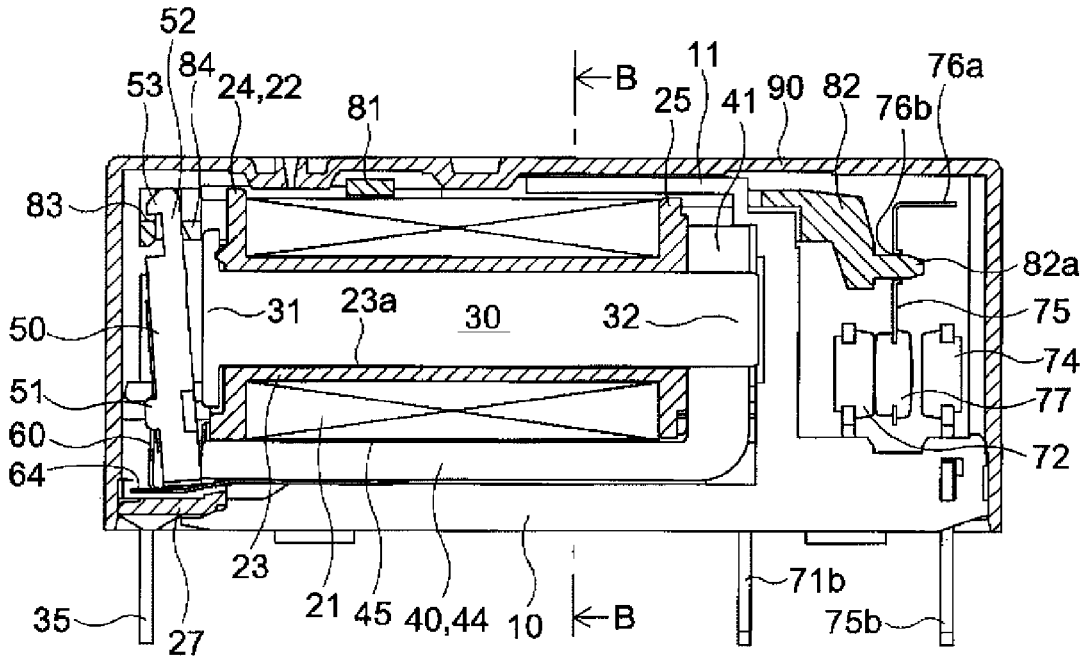
FIG. 3A and FIG. 3B are a side cross sectional view and a front cross sectional view, respectively, of the electromagnetic relay shown in FIG. 1.
Figure 3:
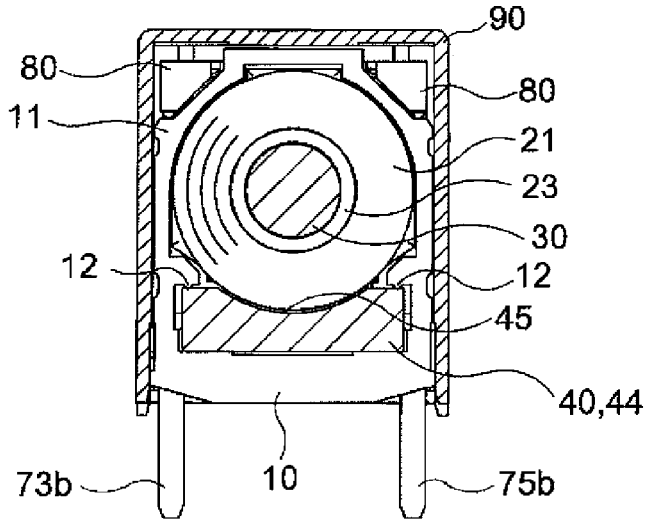

Then, the horizontal portion 44 of the yoke 40 is inserted through the insertion opening 26*a*, and the other end portion 32 of the iron core 30 is caulk-fixed to the caulking hole 42, whereby the yoke 40 is integrated with the spool 22. Therefore, a tip end surface of the horizontal portion 44 of the yoke 40 is exposed from the insertion opening 26*a* (FIG. 3).

Figure 2:
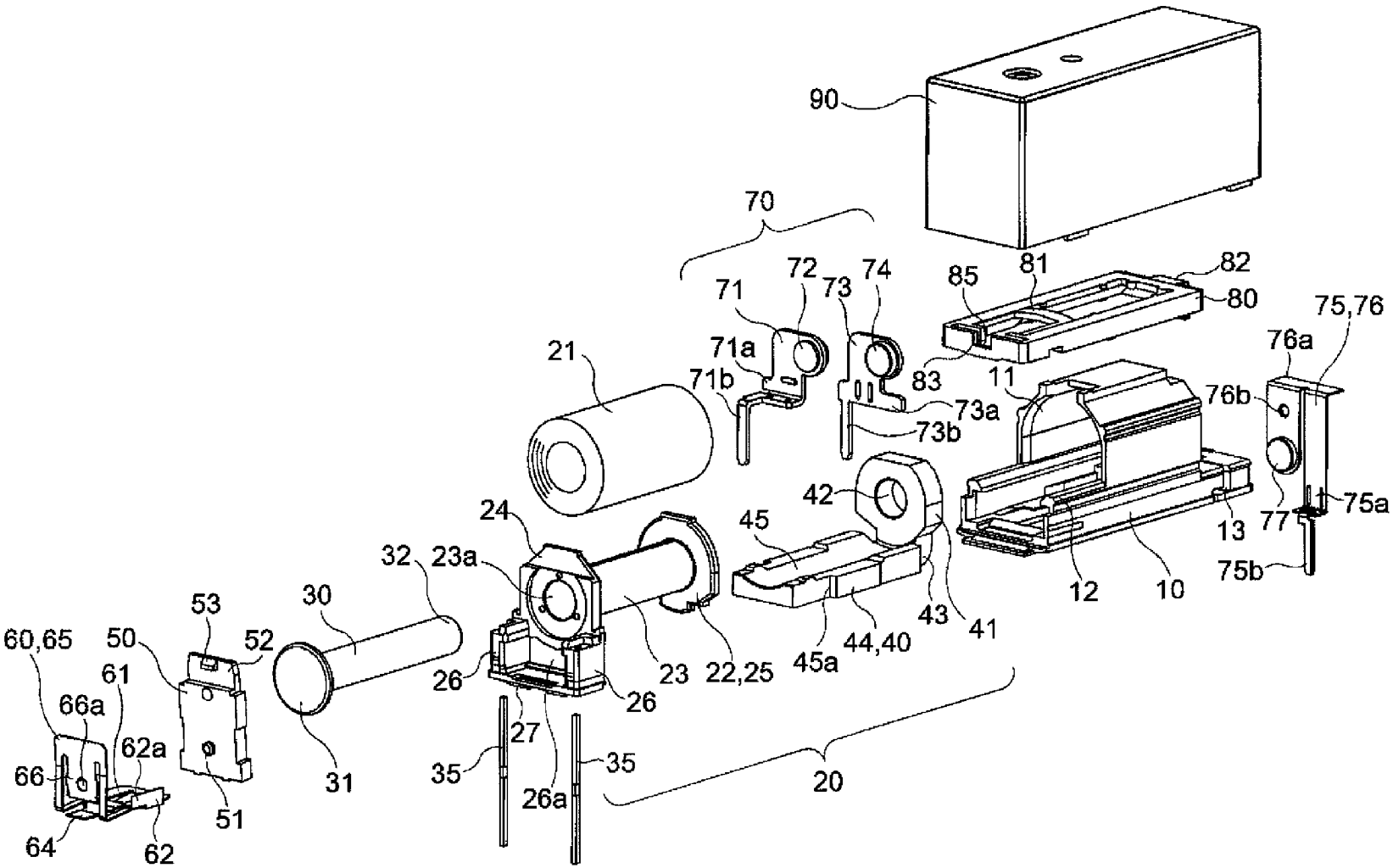
FIG. 2 is an exploded perspective view of the electromagnetic relay shown in FIG. 1.

As shown in FIG. 2, the movable iron piece 50 is made of a plate-shaped magnetic material formed by press work. Its outer surface is protrusively provided with an engagement protrusion 51 by protruding work, and an extended upper side portion 52 is formed with an engagement pawl 53. The movable iron piece 50 is rotatably supported between the pedestal portions 26, 26 of the spool 22 through a hinge spring 60, and a lower end edge portion of the movable iron piece 50 comes in contact with the tip end surface of the horizontal portion 44 of the yoke 40 (FIG. 3).

Figure 4:
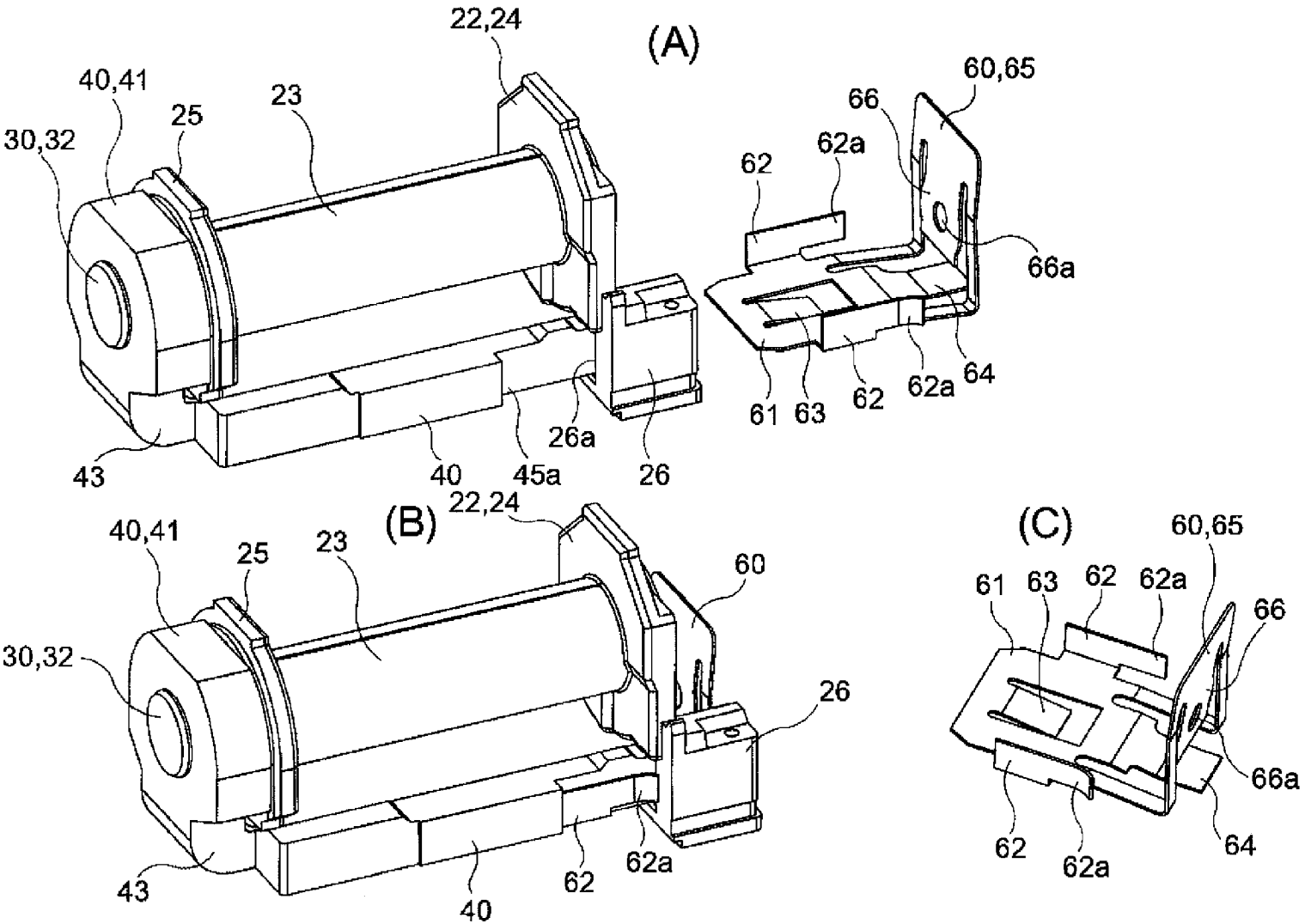
FIG. 4A and FIG. 4B are perspective views for describing an assembling method of a hinge spring.
FIG. 4C is a perspective view of the hinge spring.
Figure 5:
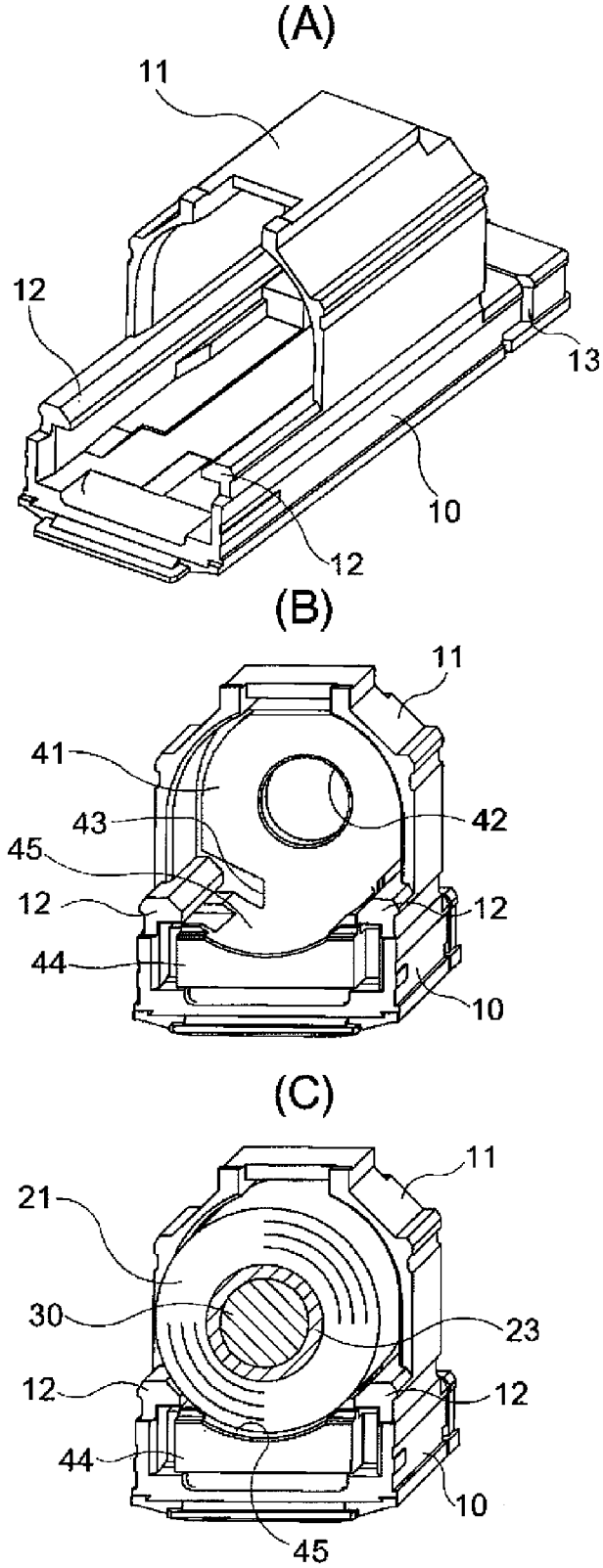
FIG. 5A is a perspective view of a base shown in FIG. 1.
FIG. 5B is a perspective view showing a state in which a yoke is assembled to the base.
FIG. 5C is a perspective view showing a state in which a coil is disposed on the base.

As shown in FIG. 4, the hinge spring 60 is formed of a thin plate spring material that is bent in a generally L-shape, and positioning ribs 62, 62 are formed by cutting and raising both side edge portions of a horizontal portion 61. Further, each positioning rib 62 is formed with an elastic pawl portion 62*a* so as to prevent the hinge spring 60 from coming off. Also, a press-fitting elastic tongue piece 63 is cut and raised at the center of the horizontal portion 61, and an assembling tongue piece 64 is cut at a cornered portion of the hinge spring 60. On the other hand, the center of a supporting elastic tongue piece 66, which is cut out of a vertical portion 65 of the hinge spring 60, is provided with a caulking hole 66*a*. In FIG. 4, the coil 21 and the movable iron piece 50 are not shown for the sake of convenience of the description.

Thereafter, after the engagement protrusion 51 of the movable iron piece 50 is caulk-fixed to the caulking hole 66*a*, the horizontal portion 61 of the hinge spring 60 is press-fitted into a gap between a bottom surface of the horizontal portion 44 of the yoke 40 and the receiving portion 27 with the assembling tongue piece 64 of the hinge spring 60 being held, and each positioning rib 62 is press-fitted into the gap 26*a* between a side surface of the yoke 40 and each pedestal portion 26. As a result, the positioning rib 62 that comes out from the gap 26*a* between the side surface of the yoke 40 and the pedestal portion 26 is engaged with a notched step portion 45*a* of the yoke 40, and the elastic pawl portion 62*a* is locked to an edge portion of the pedestal portion 26, so that the movable iron piece 50 is prevented from coming off. Thereby, the movable iron piece 50 is rotatably supported by the hinge spring 60, and the electromagnetic block 20 is completed.

In the present embodiment, the positioning ribs 62 and the gap 26*a* can be visually checked at the same time and thus there is an advantage that assembling work is facilitated.

The contact mechanism portion 70 is disposed on one side of the cylindrical-shaped cover 11 of the base 10, and consists of normally-closed, normally open fixed contact terminals 71, 73 and a movable contact terminal 75. The normally-closed, the normally open fixed contact terminals 71, 73 are obtained by continuously integrally molding press-fitting portions 71*a*, 73*a* and terminal portions 71*b*, 73*b*, respectively, at lower sides of fixed contacts 72, 74. In particular, the press-fitting portion 71*a* of the normally-closed side fixed contact terminal 71 is bent generally at right angles.

In the movable contact terminal 75, a connection portion of a movable contact piece 76 formed by being punched in a generally J-shape 76*a* is bent generally at right angles to form a rib portion 76*a* serving as a rotational fulcrum, and a movable contact 77 is caulk-fixed to a free end portion thereof. Further, right above the movable contact 77, a protrusion 82*a* of a card 80 described below is inserted, and an engagement opening 76*b* serving as a point of action is formed. Therefore, a shaft center of the engagement opening 76*b* and a shaft center of the movable contact 77 are located on the same vertical surface.

In the movable contact terminal 75, a press-fitting portion 75*a* located at a basal portion of the movable contact piece 76 is press-fitted sideways into a slit 13, which is provided in one side edge portion of the base 10, whereby a terminal portion 75*b* is protruded from a bottom surface of the base 10. Further, the press-fitting portions 71*a*, 73*a* of the normally-closed, normally open fixed contact terminals 71, 73 are press-fitted sideways into a pair of slits 14, 15, respectively, which are provided in an edge portion on the opposite side of the slit 13 for the movable contact terminal. Thereby, the terminal portions 71*b*, 73*b* are protruded from the bottom surface of the base 10, and the movable contact 77 and the fixed contacts 72, 74 are opposite to each other so that they can be respectively contacted with and separated from each other.

Subsequently, both the side edge portions of the horizontal portion 44 of the yoke 40 are inserted in a sliding manner so as to be engaged with the pair of the engagement pawls 12, 12, and a part of the electromagnetic block 20 is inserted into the cylindrical-shaped cover 11, whereby the base 10 and the electromagnetic block 20 are integrated with each other.

The card 80 is for connecting the movable iron piece 50 and the movable contact terminal 75. It has a rectangular frame shape in plan view, and its middle portion is provided with a connection portion 81. In particular, frame portions in a lengthwise direction each have a generally triangular shape in cross section (refer to FIG. 3B), and therefore a dead space can be effectively used, so that there is an advantage that the entire device can be reduced in size. Further, the card 80 is provided sideways with an engagement projection 82*a* protruding from the center of a tip end surface of a pressing arm portion 82, which is provided protruding from the center of a tip end surface of one end side of the card 80. Further, a central portion of the other end side of the card 80 is formed with an engagement recess 83, and a pair of protrusions 84, 84 are protrusively provided on the same shaft center in its inside, whereby an adjustment opening 85 is formed between the protrusions 84.

Then, while the engagement projection 82*a* is inserted through the engagement opening 76*b*, both side edge portions of the upper side portion 52 of the movable iron piece 50 are held by one end portion of the card 80 and the pair of the protrusions 84, 84, and the engagement pawl 53 of the movable iron piece 50 is engaged with the engagement recess 83 to prevent the card 80 from coming off.

The case 90 has a box shape capable of covering the base 10. The case is assembled to the base 10 to which internal components are assembled, whereby an assembling work is completed.

Next, an operation method of the electromagnetic relay will be described.

That is, if a voltage is not applied to the coil 21 of the electromagnetic block 20, the card 80 is urged to the movable iron piece 50 side by a spring force of the movable contact piece 76. Therefore, the movable contact 77 is in contact with the normally-closed fixed contact 72, and separated from the normally open fixed contact 74.

Then, by applying a voltage to the coil 21 of the electromagnetic block 20, the magnetic pole portion 31 of the iron core 30 attracts the movable iron piece 50. Therefore, the movable iron piece 50 is rotated against the spring force of the movable contact piece 76, whereby the card 80 is moved in a sliding manner in a horizontal direction to press the movable contact piece 76, so that the movable contact 77 is separated from the fixed contact 72, brought into contact with the fixed contact 74 and then the movable iron piece 50 is attracted to the magnetic pole portion 31.

Then, if the voltage application to the coil 21 is stopped, the card 80 is pushed back by the spring force of the movable contact piece 76, and the movable iron piece 50 is separated from the magnetic pole portion 31. Thereafter, the movable contact 77 is separated from the fixed contact 74 and brought into contact with the fixed contact 72 to return to the original state.

Figure 6:
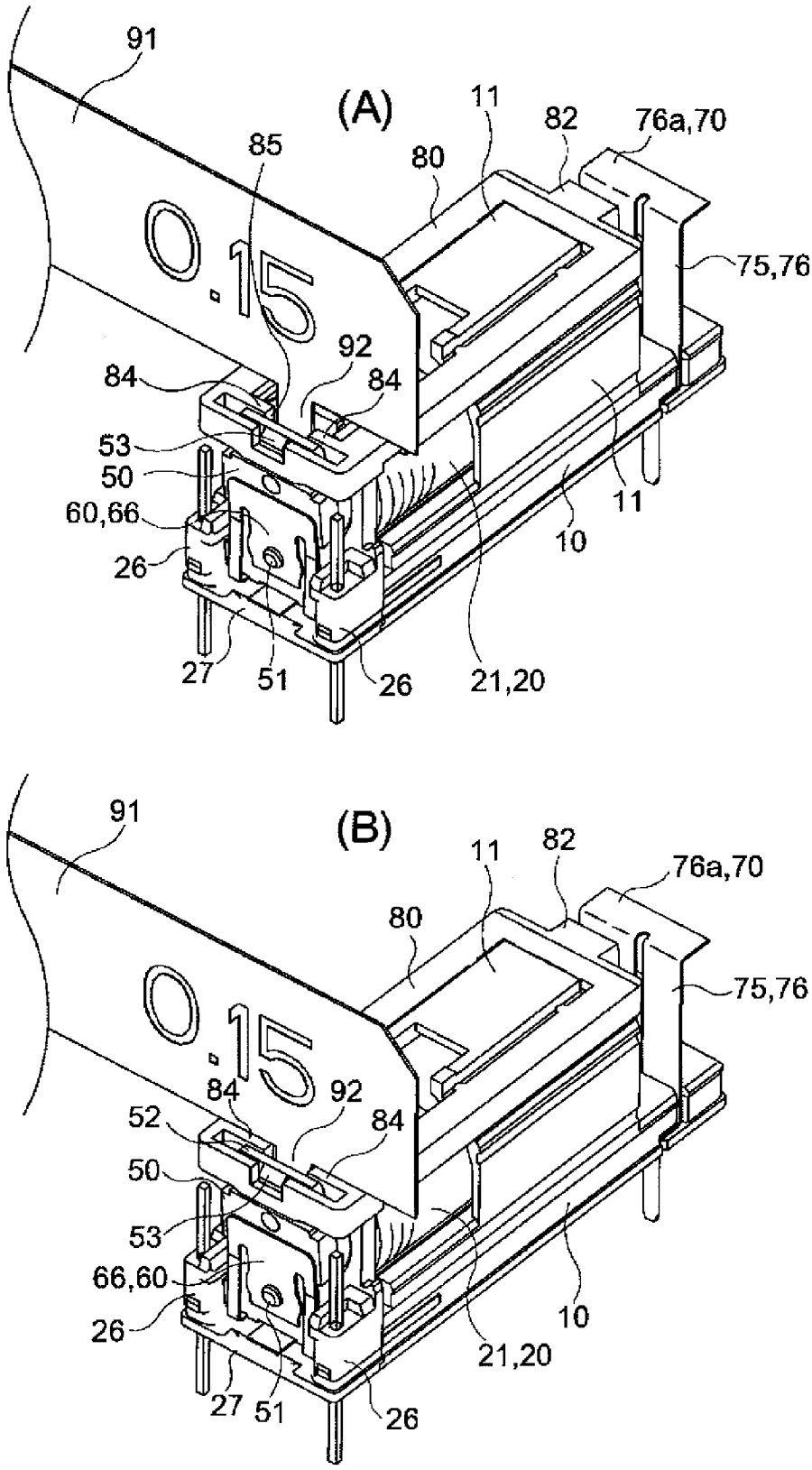
FIG. 6A and FIG. 6B are perspective views for describing an adjustment method using a thickness gauge.

If operation characteristics of the electromagnetic relay of the present embodiment are adjusted, as shown in FIG. 6, for example, a gauge portion 92 of a thickness gauge 91 having a thickness of 0.15 mm is inserted into the adjustment opening 85 formed between the pair of the protrusions 84, 84. Then if a voltage is applied to the coil 21 to rotate the movable iron piece 50, and the gauge portion 92 is held by the movable iron piece 50 and the magnetic pole portion 31 of the iron core 30, whether or not the movable contact 77 is in contact with the normally open fixed contact 74 is judged by an electrical means. If they are not in contact with each other, since it means that a predetermined stroke with respect to the normally open fixed contact 74 is not obtained, the fixed contact terminal 73 and the like are slightly deformed to adjust the operation characteristics.

Figure 7:
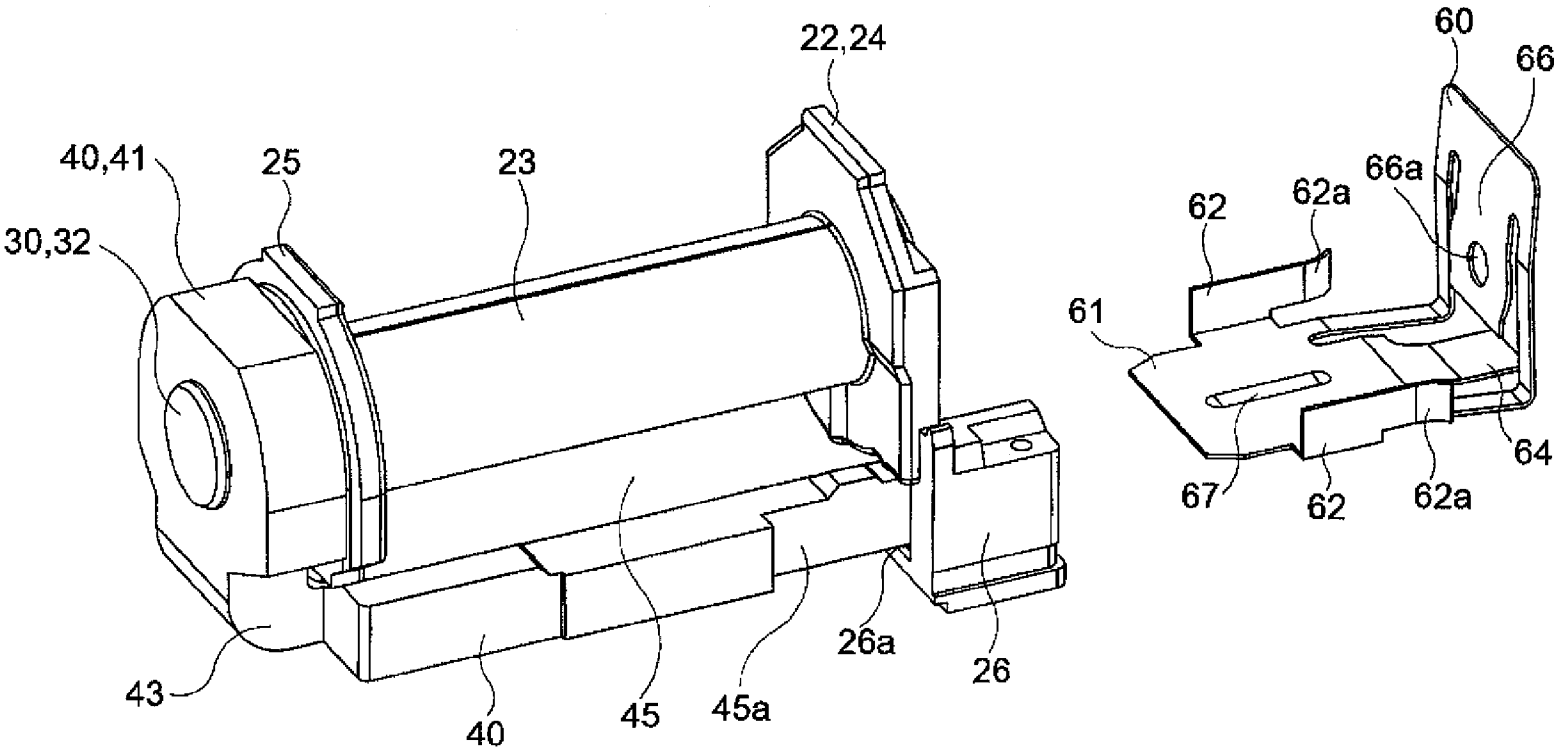
FIG. 7 is a perspective view showing a spool and a hinge spring according to a second embodiment.

A second embodiment is a case where a press fitting protrusion 67 is provided by protruding work in place of the press-fitting elastic tongue piece provided at the horizontal portion 61 of the hinge spring 60 as shown in FIG. 7. According to the present embodiment, there is an advantage that the hinge spring 60 can be prevented from coming off without reducing its strength. Since the other portions are the same as those in the above embodiment, the same portions are designated by similar numerals and the description thereof is omitted.

Figure 8:
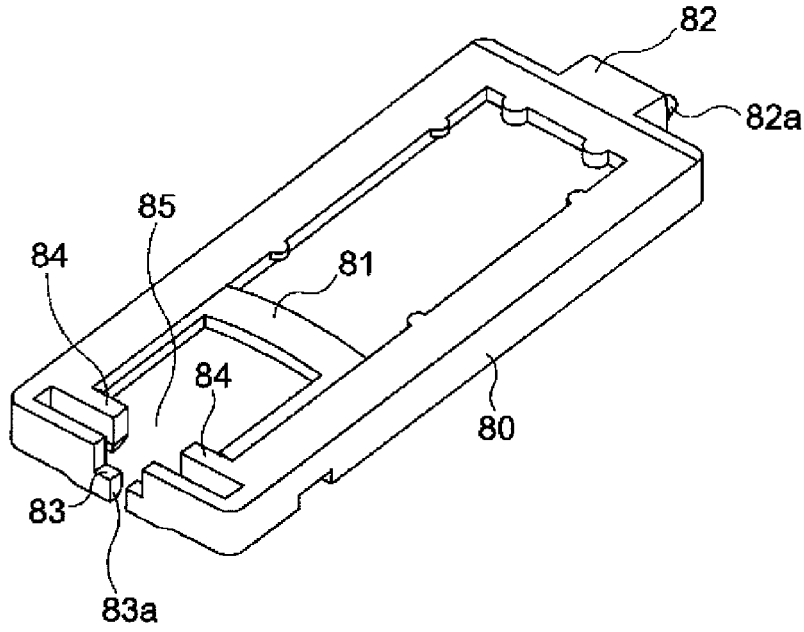
FIG. 8A and FIG. 8B are perspective views showing a card and an electromagnetic relay, respectively, according to a third embodiment.
Figure 8:
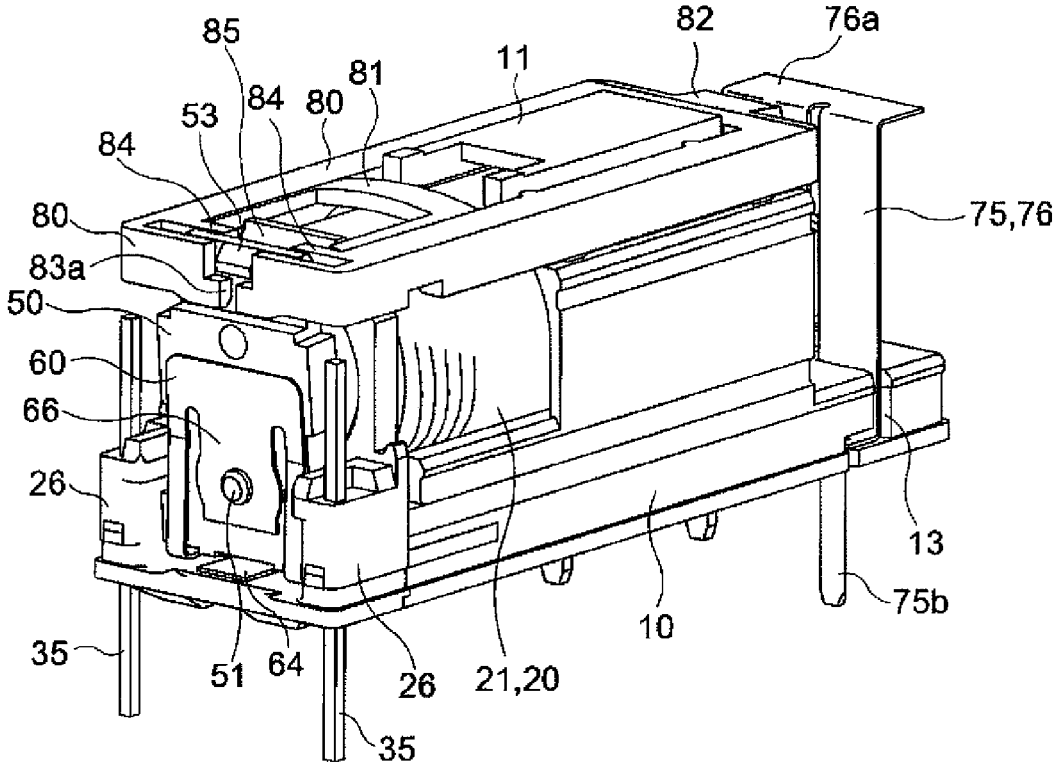

A third embodiment is a case where the center of one end portion of the card 80 is provided with a slit 83*a* as shown in FIG. 8. According to the present embodiment, the one end side of the card 80 is easily elastically deformed, and the engagement pawl 53 is easily engaged, so that there is an advantage that assembling performance is improved.

INDUSTRIAL APPLICABILITY

The electromagnetic relay of the present invention can be applied not only to the above electromagnetic relays but also to other electromagnetic relays.

The invention claimed is:

1. An electromagnetic relay comprising:

an electromagnetic block formed by winding a coil around an iron core;

a frame shaped card, wherein one end portion of the frame-shaped card is engaged with a movable iron piece that is rotated by being attracted to and separated from a magnetic pole portion of the iron core based on excitation and non-excitation of the electromagnetic block;

a contact mechanism portion configured to be disposed on the other end portion side that is on an opposite side of the magnetic pole portion of the iron core, and driven by the other end portion of the frame-shaped card that makes a reciprocating movement so as to open/close contacts and a pair of protrusions are respectively protrusively provided on the same shaft center at opposite insides of the one end portion of the frame-shaped card, wherein both side edge portions of the movable iron piece are held by the one end portion of the card and the protrusions, and wherein an adjustment opening having a width dimension that allows a gauge portion of a thickness gauge to be inserted thereinto is provided between the pair of protrusions.

2. The electromagnetic relay according to claim 1, further comprising an engagement pawl configured to engage with the one end portion of the frame-shaped card at an upper end edge portion of the movable iron piece.

3. The electromagnetic relay according to claim 2, further comprising intermediate portions on both opposite sides of the frame-shaped card, wherein the intermediate portions are bridged over by a connection portion.

4. The electromagnetic relay according to claim 1, further comprising intermediate portions on both opposite sides of the frame-shaped card, wherein the intermediate portions are bridged over by a connection portion.

5. An electromagnetic relay comprising:

an electromagnetic block formed by winding a coil around an iron core;

a frame shaped card, wherein one end portion of the frame-shaped card is engaged with a movable iron piece that is rotated by being attracted to and separated from a magnetic pole portion of the iron core based on excitation and non-excitation of the electromagnetic block; and a contact mechanism portion configured to be disposed on the other end portion side that is on an opposite side of the magnetic pole portion of the iron core, and driven by the other end portion of the frame-shaped card that makes a reciprocating movement so as to open/close contacts, wherein a pair of protrusions are respectively protrusively provided on the same shaft center at opposite insides of the one end portion of the frame-shaped card, and the center of the one end portion of the card is provided with a slit, whereby both side edge portions of the movable iron piece are held by the one end portion of the card and the protrusions, and an adjustment opening having a width dimension that allows a gauge portion of a thickness gauge to be inserted thereinto is provided between the pair of protrusions.

6. The electromagnetic relay according to claim 5, further comprising an engagement pawl configured to engage with the one end portion of the frame-shaped card at an upper end edge portion of the movable iron piece.

7. The electromagnetic relay according to claim 5, further comprising intermediate portions on both opposite sides of the frame-shaped card, wherein the intermediate portions are bridged over by a connection portion.

* * * * *